US006932656B2

(12) United States Patent
Kan

(10) Patent No.: US 6,932,656 B2
(45) Date of Patent: Aug. 23, 2005

(54) CONNECTOR WITH IMPROVED STRUCTURE

(76) Inventor: Chin-Mao Kan, No.20, Ln.211, Pu Chung Rd., ChungLi, TaoYuan (TW)

( * ) Notice: Subject to any disclaimer, the term of this patent is extended or adjusted under 35 U.S.C. 154(b) by 34 days.

(21) Appl. No.: 10/737,737

(22) Filed: Dec. 18, 2003

(65) Prior Publication Data

US 2005/0136748 A1 Jun. 23, 2005

(51) Int. Cl.[7] ..... H01R 13/64
(52) U.S. Cl. ..... 439/681; 439/676; 439/144
(58) Field of Search ..... 439/680–681, 439/668, 418, 941, 676, 344, 544, 596, 135–144

(56) References Cited

U.S. PATENT DOCUMENTS 5,679,013 A * 10/1997 Matsunaga et al. ..... 439/144
6,142,834 A * 11/2000 Liao ..... 439/676
6,193,522 B1 * 2/2001 Liao ..... 439/31
6,257,935 B1 * 7/2001 Zhang et al. ..... 439/680
6,383,028 B1 * 5/2002 Chang ..... 439/638
6,409,549 B1 * 6/2002 Yeh ..... 439/676
6,508,677 B1 * 1/2003 Wang ..... 439/676

* cited by examiner

*Primary Examiner*—Gary Paumen
*Assistant Examiner*—Edwin A. Leon
(74) *Attorney, Agent, or Firm*—Troxell Law Office, PLLC

(57) ABSTRACT

A connector with improved structure, adapted for connecting a signal plug, is mainly comprised of a body, a pin plate, and a cap. Wherein, a plurality of recesses are arranged over the body, side of which has at least one gap, and a plurality of pins are arranged over the pin plate, side of which also has at least one protrusion. When the body and the pin plate are connected, the protrusion and the gap are inter-wedged, and the pin is abutted against one side of the recess. The cap of the present embodiment is connected pivotally over the body and may be rotated with an angle, so a signal plug may be inserted into the space formed by both the body and the cap with a slant angle and be restricted by the cap without dropping off.

7 Claims, 5 Drawing Sheets

CONNECTOR WITH IMPROVED STRUCTURE

FIELD OF THE INVENTION

The invention is related to a connector, and in particular, to a connector having a dust-proofing cap for inserting therein a signal plug at an angle.

BACKGROUND OF THE INVENTION

In recent years, in associated with the progress of technology, all kinds of information product had been developed that not only the convenience of human living is improved, but also the distance between each other is further shortened. However, the more advanced the technology is, the more demanding in the speed of information transmission will be, yet, the transmission of information and connection between information product are accomplished using connectors and connecting lines. Among those, the most commonly seen and having the most varieties of application are the connectors responsible for network cabling. For instance, the internet card, hub, and IP router are all use connectors and plugs for bridging between electronic signals.

FIG. 1 is a schematic drawing showing a connector of prior arts. FIG. 2A is a schematic drawing showing a signal plug of prior arts. Please refer to FIG. 1 and FIG. 2A, the connector 100 of prior arts mainly comprises: a body 102 having two stoppers arranged on top thereof and a recess 108 arrange at the middle thereof, and a plurality of pins 104 arranged at the bottom of the body 102, wherein the body 102 is made of plastic. In addition, the shape of the signal plug 200 is corresponding to the shape of the recess 108 and the signal plug 200 also has a plurality of metallic pieces 204 whose positions are corresponding to those of the pins 104 of the body 102. However, a fixing piece 206 with elasticity is arranged at the top of the signal plug 200 that the fixing piece 206 has a wider first side 208 and a corresponding narrower second side 210. When the signal plug 200 is inserted into the connector 100, not only the plural pins 104 of the connector 100 are inter-contacted respectively with the corresponding metallic pieces 204 of the signal plug 200, but also does the first side 208 of the fixing piece 206 pass through under the stopper 106 and then lift up to be wedged into the recess between the two stoppers 106, such that the signal plug 200 is fixed.

FIG. 2B is a schematic drawing depicting that a signal plug is inserted into a connector. As seen in FIG. 2B, a common connector 100 is fixed to the wall 212 and, when it is desired to connect the signal plug 200 to the connector 100, the signal plug 200 should be inserted vertically to the wall, and the guiding line adjacent to the signal plug 200 is then fixed to the wall 212.

However, there are shortcomings of the connection method seen in FIG. 2, which are listed following:

1. When connecting the connector of prior arts with the signal plug, the guiding line adjacent to the signal plug must be bent first for enabling the insertion of the signal plug into the connector, then the bent guiding line is fixed to the wall; however, the excessive bending of the guiding line will deteriorate the transmitting effectiveness of the signal in the long term.
2. When the prior connector is not connected with the signal plug for a certain period of time, the connector is prone to be covered and invaded by dust such that the effectiveness of signal transmission is affected.

SUMMARY OF THE INVENTION

Therefore, the object of the present invention is to provide a connector adapted for enabling the insertion of a signal plug therein at an angle, such that the guiding line adjacent to the signal plug is free from an excessive bending.

Another object of the present invention is to provide a connector with function of dust-proof.

To achieve the aforementioned objects, the present invention provides an improved connector having a dust-proofing cap for inserting therein a signal plug at an angle, which is mainly comprises: a body having at least a gap located at the rear thereof; a pin plate having at least a protrusion arrange at a side thereof; and a cap pivotally coupled to the top of the body, wherein, while assembling the body with the pin plate, the gap is inter-engaged with the protrusion for fixing, and a signal plug may be inserted into the body at an angle that is prevented from dropping off by the restriction of the cap.

Moreover, in a preferred embodiment of the present invention, the pin plate also has a plurality of copper pins which have smaller bending angles. In addition, a plurality of stoppers are further arranged on the inner side of the cap, and the interior of the signal plug also has a corresponding plurality of metallic pieces. When the signal plug is inserted into the connector at an angle, the stopper not only affixes the signal plug, but also ensures the contact of the metallic piece to the pin.

The present invention adopts a cap capable of rotating for enabling the insertion of the signal plug into the connector at an angle, such that the guiding line adjacent to the signal plug in not overly bent, and the cap may be pressed down to have a dust-proofing effect when the signal plug is not inserted in the connector.

Following drawings are cooperated to describe the detailed structure and its connective relationship according to the invention for facilitating your esteemed members of reviewing committee in understanding the characteristics and the objectives of the invention.

DETAILED DESCRIPTION OF THE INVENTION

For your esteemed members of reviewing committee to further understand and recognize the fulfilled functions and structural characteristics of the invention, several preferable embodiments cooperating with detailed description are presented as the follows.

Figure 1:
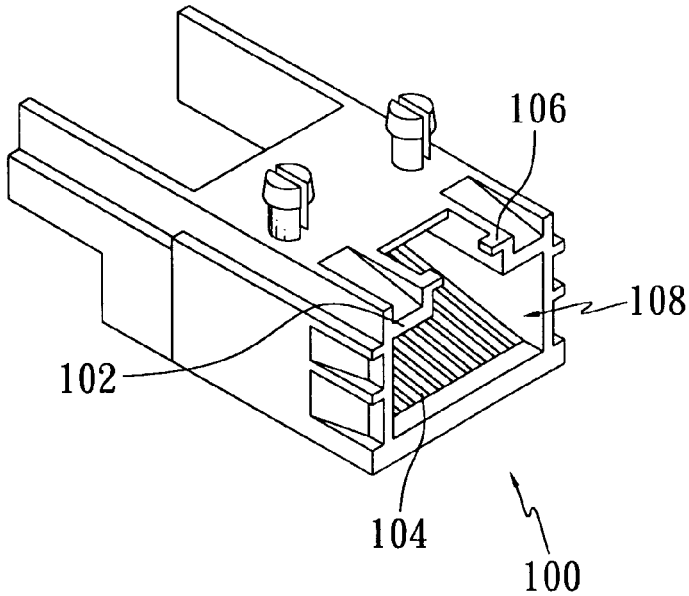
F I G. 1 (PRIOR ART)
FIG. 1 is a schematic drawing showing a connector of prior arts.
Figure 2A:
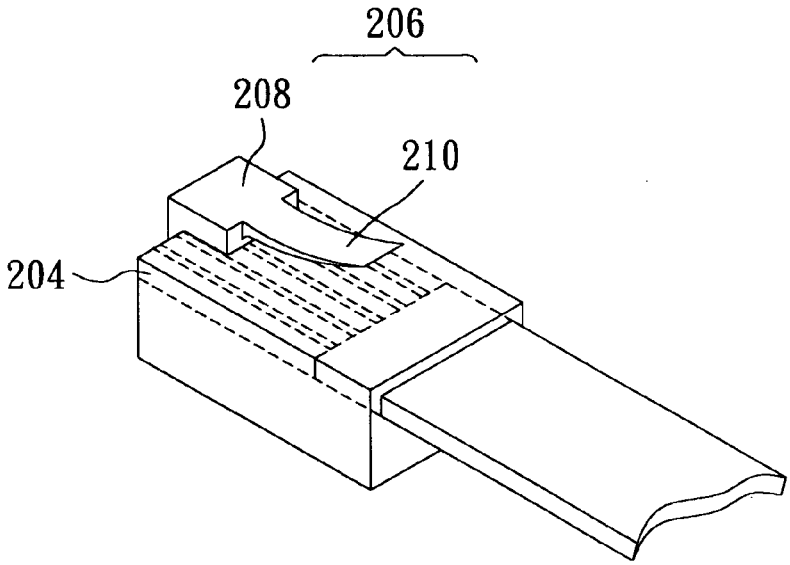
F I G. 2A (PRIOR ART)
FIG. 2A is a schematic drawing showing a signal plug of prior arts.
Figure 2B:
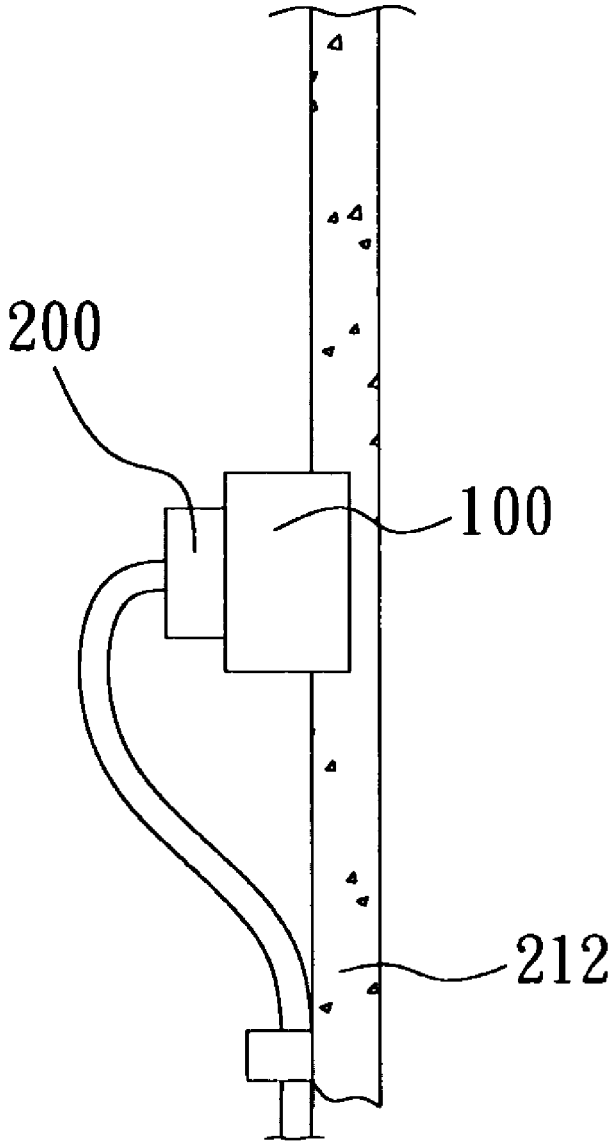
F I G. 2B (PRIOR ART)
FIG. 2B is a schematic drawing depicting that a signal plug is inserted into a connector according to prior arts.
Figure 3:
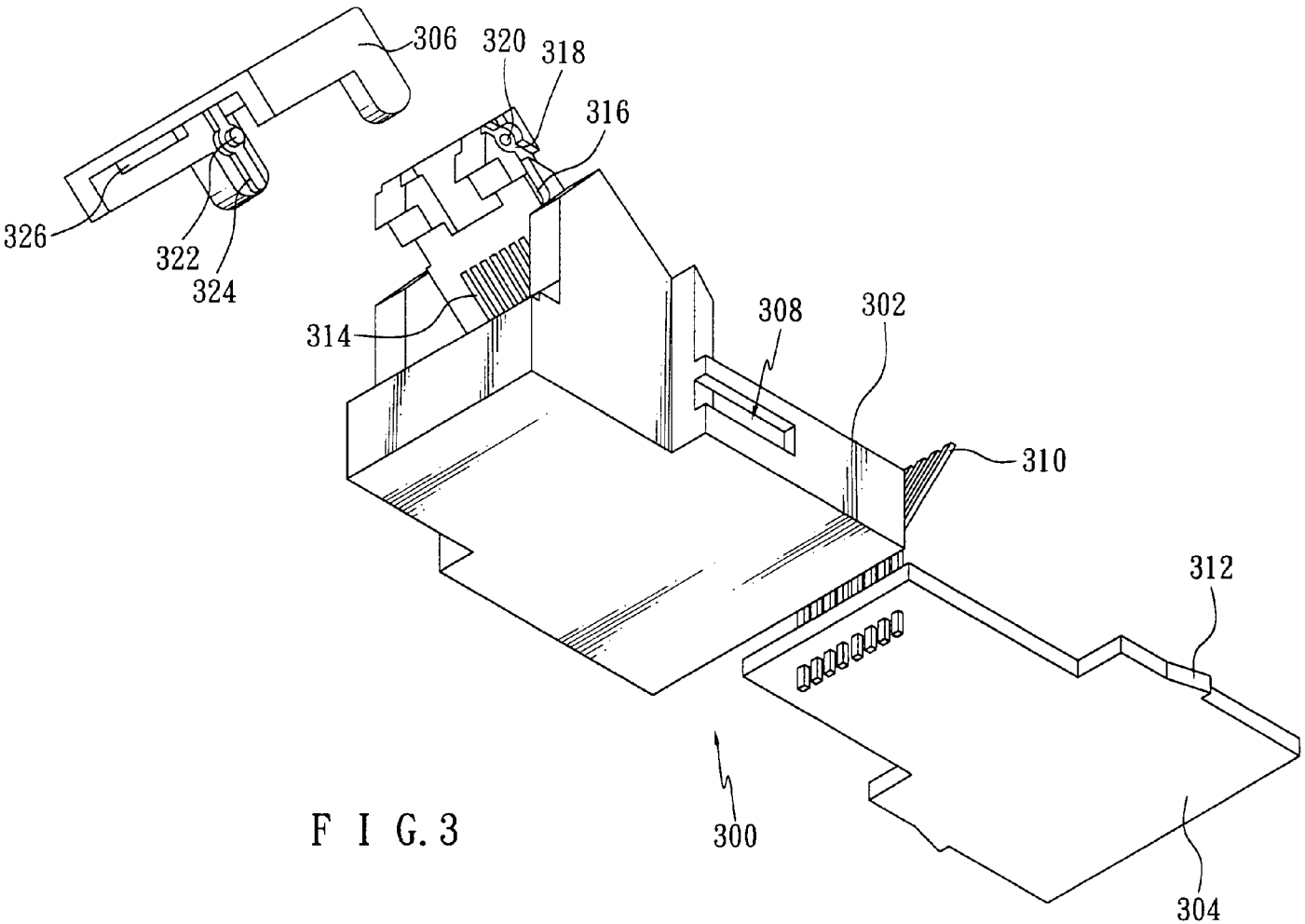
FIG. 3 is a schematic drawing depicting a connector with improved structure according to a preferred embodiment of the present invention.

FIG. 3 is a schematic drawing depicting a connector with improved structure according to a preferred embodiment of the present invention. Please refer to FIG. 3. In this embodiment, the invention proposes a connector with improved structure 300, having a cap 306, adapted for connecting a signal plug 200 (FIG. 2A), mainly comprises: a body 302, a pin plate 304, and a cap 306. Wherein, the rear side of the body 302 has at least one gap 308 and, above the pin plate 304, there are a plurality of protruding pins 310, bending angles of which are smaller, and which may be made of copper. In this embodiment, the side of the pin plate 304 also has at least one protrusion 312. When the body 302 and the pin plate 304 are connected, the protrusion 312 and the gap 308 are inter-wedged to be fixed. The cap 306 of this embodiment is connected pivotally over the body 302, so a signal plug 200 may be inserted into the space formed by both the body 302 and the cap 306 with a slant angle and be restricted by the cap 306 without dropping off.

Please refer to FIG. 3 continuously. At the inside above the body 302, there are a plurality of recesses 314, the positions of which are inter-corresponding to those of guiding pins 310. When the body 302 is connected the pin plate 304, the pin 310 will be abutted against one side of the recess 314. However, the connector 300 of this embodiment may be made of plastic so, when manufacturing, it is possible to manufacture the body 302 and the pin plate 304 by integrally injecting formation or both may be manufactured separately and be assembled again.

According to aforementioned description, two sides above the body 302 of this embodiment respectively and externally have a first groove 316 and a second groove 318, both of which are intercrossed, and a recessing hole 320 is arranged respectively at the intercrossing places. Two sides of the cap 306 internally and respectively have a projecting axis 322 and a tenon 324 (arranged under the projecting axis 322), and the sizes of the two tenons 324 are inter-corresponding to those of the two grooves 316, 318, and the sizes of the two projecting axes 322 are also inter-corresponding to those of the two recessing holes 320, such that the tenon 324 may be rotated around the recessing hole 320 by the projecting axis 322 to make the tenon 324 override the middle part of the two grooves 316, 318 to move to another groove, so the cap 306 may be open or closed corresponding to the body 302.

From the aforementioned FIG. 2A, it is known that the interior of the signal plug 200 of this embodiment has a plurality of metallic pieces 204, and a fixing piece 206 with elasticity is arranged above the signal plug 200. The fixing piece 206 may be made of plastic and has a first side 208 and a corresponding second side 210, and the width of the first side 208 is larger, and the width of the second side 210 is smaller.

Figure 4A:
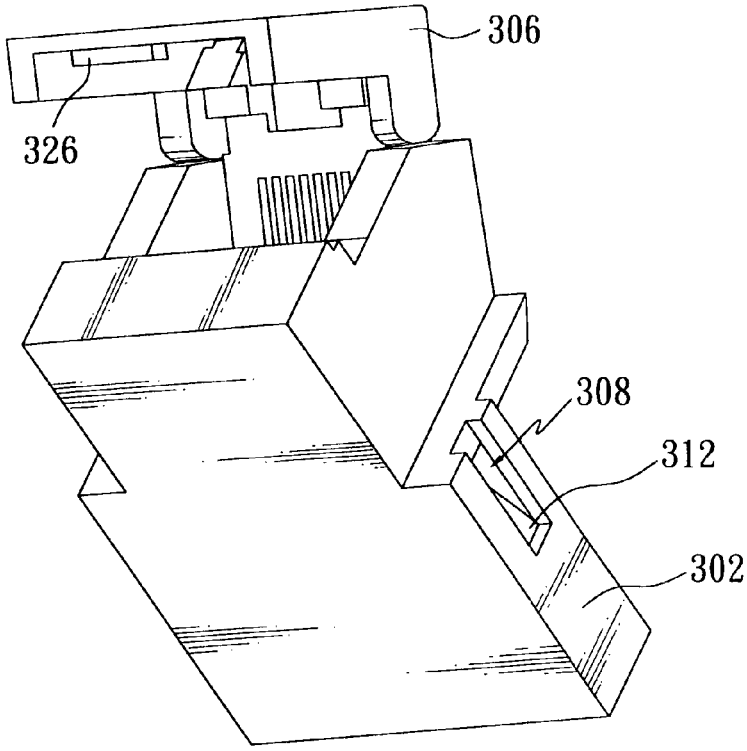
FIG. 4A is a schematic drawing depicting a connector with improved structure according to a preferred embodiment of the present invention, wherein the cap is open.
Figure 4B:
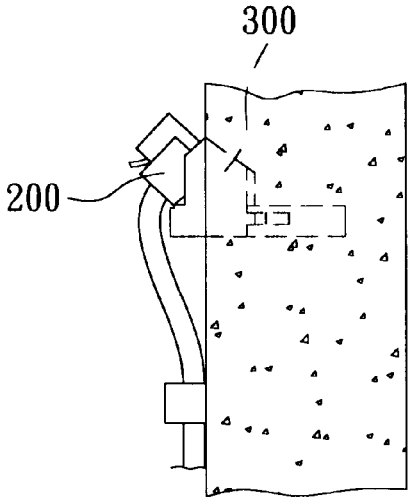
FIG. 4B is a schematic drawing depicting that a signal plug is inserted into a connector according to the present invention.

FIG. 4A is a schematic drawing depicting a connector with improved structure according to a preferred embodiment of the present invention, wherein the cap is open. FIG. 4B is a schematic drawing depicting that a signal plug is inserted into a connector according to the present invention. Please refer to FIG. 3, FIG. 4A, and FIG. 4B simultaneously. The inside of the cap 306 of this embodiment also has a plurality of stop plates 326 so, when it is desired to insert the signal plug 200 into the connector 300, because the tenon 324 is located in the first groove 316 and the cap 306 is corresponding to the body 302 to be in an open state, the signal plug 200 may be inserted into the connector 300 with a slant angle without bending the adjacent signal plug 200. Not only may the a plurality of guiding pin 310 of the connector 300 be interconnected correspondingly to the a plurality of metallic pieces 204 possessed by the signal plug 200 but also, after passing under the stop plate 326, the first side 208 of the fixing piece 206 will be lifted up to block the stop plate 326, such that the signal plug 200 is fixed.

Figure 5:
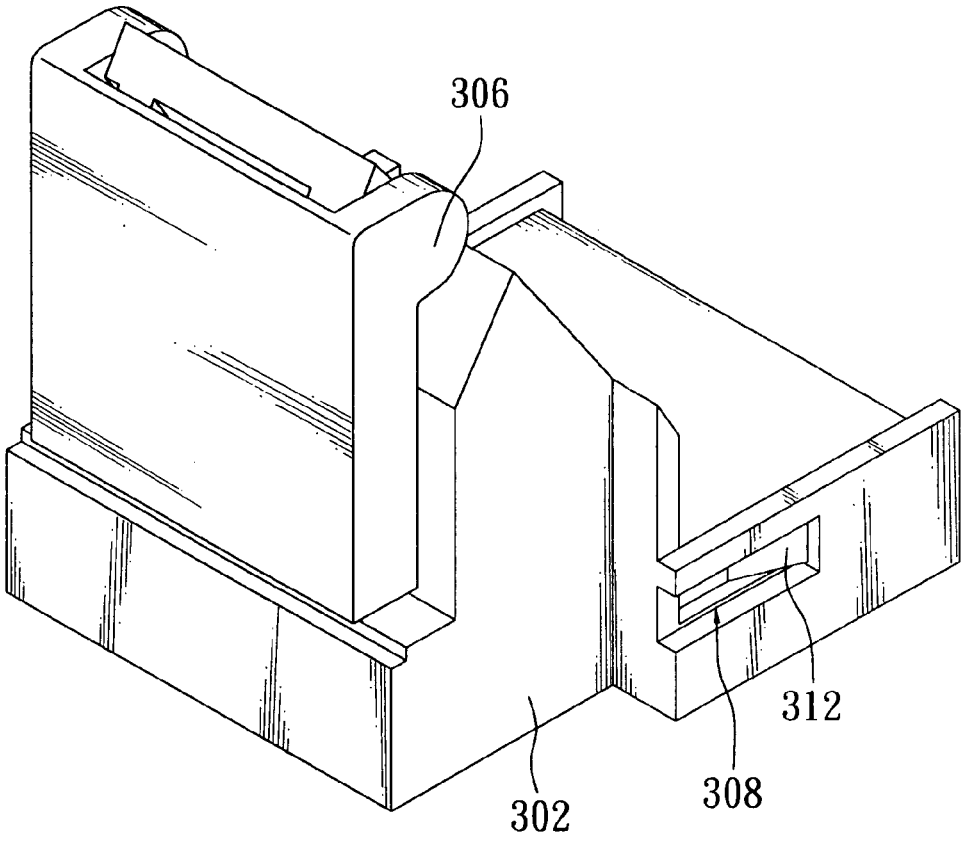
FIG. 5 is a schematic drawing depicting a connector with improved structure according to a preferred embodiment of the present invention, wherein the cap is closed.

FIG. 5 is a schematic drawing depicting a connector with improved structure according to a preferred embodiment of the present invention, wherein the cap is closed. When the signal plug 200 is not inserted in the connector 300, a pressing down force is exerted at the cap 306 to make the tenon 324 override the middle part of the first groove 316 and the second groove 318, such that the tenon 324 is finally located at the position of the second groove 318 to make the cap 306 be corresponding to the body 302 and be in a closed state to have a dust-proofing effectiveness.

In the aforementioned preferred embodiments, a cap with adjustable angle may be arranged to make the signal plug be able to be inserted into the connector with a slant angle. However, the aforementioned descriptions are only exemplified embodiments and are not applied for restricting any formation of the cap of the invention, so those who are skilled in such arts should understand that the projecting axis and the tenon of the invention may be interchanged with the recessing hole and the groove of the body.

In summary, the connector with improved structure according to the invention has at least following advantages:

1. The connector with improved structure according to the present invention may make a signal plug be inserted into a connector with a slant angle, such that the bending angle of the guiding line of the adjacent signal plug is small, even when the guiding line is fixed to the wall in the long term, the bending place of the guiding line won't be fatigued as well, so its life span may be prolonged.
2. Since the connector with improved structure of the present invention has a cap so that, when in closed state, it possesses an excellent dust-proofing effect.
3. In the connector with improved structure according to the present invention, the pin of the pin plate is bent with a small angle so that, even when the pin is used in the long term, it won't be fatigued as well and the transmitting speed won't be influenced neither.
4. The manufacturing cost of the connector with improved structure according to the present invention is so cheap that it is suitable for mass production.

However, the aforementioned description is only the preferable embodiments according to the invention and, of course, can not be applied as a limitation to the field of the invention, and any equivalent variation and modification made according to the claims claimed thereinafter still possess the merits of the invention and are still within the spirits and the ranges of the invention, so they should be deemed as a further executing situation of the invention.

What is claimed is:

1. A connector with improved structure, adapted for connecting to a signal plug, comprising:

a body, having at least a gap arranged at a side of the rear thereof;

a pin plate, having at least a protrusion arrange at a side thereof for inter-locking with the gap of the body, and having a plurality of pins; and a cap, connected pivotally at the top of the body;

wherein, the signal plug is inserted into the body at an angle and is prevented from dropping off by the restriction of the cap, wherein both external sides of the body respectively has a plurality of intercrossing grooves arranged at the top thereof, and a hole is arranged at each intersection of the plural grooves; and both the two inner sides of the cap respectively has a protruding axis and a tenon arranged on the protruding axis, also the size of the tenon is corresponding to that of the hole, and the size of the protruding axis is corresponding to that of the grooves, such that the tenon is capable of rotating around the hole for enabling the protruding axis to override the middle part of the plural grooves to move from one groove to another.

2. The connector with improved structure according to claim 1, wherein the structure is made of plastic.

3. The connector with improved structure according to claim 1, wherein the manufacturing method of the body and the pin plate is one of the following: integrally injecting formation and separated manufacture.

4. The connector with improved structure according to claim 1, wherein the cap further has a plurality of stoppers arranged inside thereof for fixing the signal plug.

5. The connector with improved structure according to claim 1, wherein the body further has a plurality of recesses arranged at the top of the inner side thereof, and the positions of the plural recesses are corresponding to the plural pins such that, when the body is connected to the pin plate, the top of the pin is abutted against an end of the corresponding recess.

6. The connector with improved structure according to claim 1, wherein the signal plug has plural metallic pieces and, when the signal plug is inserted into the structure, the plural metallic pieces are inter-contacted with the corresponding plural pins.

7. The connector with improved structure according to claim 6, wherein the plural pins are made of copper.

* * * * *